US009091412B2

(12) United States Patent
Yeh

(10) Patent No.: US 9,091,412 B2
(45) Date of Patent: Jul. 28, 2015

(54) LENS FOR ILLUMINATION DEVICE

(71) Applicant: Chen-Wei Hsu, Tainan (TW)

(72) Inventor: Chien Hung Yeh, Tainan (TW)

(73) Assignee: Chen-Wei Hsu, Rende Dist., Tainan (TW)

( * ) Notice: Subject to any disclaimer, the term of this patent is extended or adjusted under 35 U.S.C. 154(b) by 105 days.

(21) Appl. No.: 14/135,589

(22) Filed: Dec. 20, 2013

(65) Prior Publication Data

US 2015/0176799 A1 Jun. 25, 2015

(51) Int. Cl.
*F21V 5/04* (2006.01)

(52) U.S. Cl.
CPC ..... *F21V 5/04* (2013.01)

(58) Field of Classification Search
CPC ..... F21V 5/04
USPC ..... 362/335
See application file for complete search history.

(56) References Cited

U.S. PATENT DOCUMENTS 7,826,040 B2 * 11/2010 Wolf et al. ..... 356/4.01

* cited by examiner

*Primary Examiner* — David V Bruce

(57) ABSTRACT

A lens for an illumination device includes a lens having a first surface and a second surface which is connected to the second surface along an annular curved line which is composed of two symmetric curved lines. The two curved lines are connected to each other at a first end point and a second end point. Each of the two curved lines has a middle point. The first surface is a multiple-focus surface and located on the outer side of the lens. The patterns and paths of the light beams can be controlled by the first surface of the lens.

4 Claims, 6 Drawing Sheets

LENS FOR ILLUMINATION DEVICE

BACKGROUND OF THE INVENTION

1. Fields of the Invention

The present invention relates to a lens, and more particularly, to a lens for an illumination device and the lens has a multi-focus surface to control the paths and patterns of the light beams.

2. Descriptions of Related Art

The conventional Light Emitting Diode (LED) illumination devices use LEDs as the light source and which has a longer term of life and saves energy. When higher illumination feature is needed, the number of the LEDs are installed, however, the multiple LEDs create multiple light ports on the object to be illuminated and this easily cause fatigue of eyes. A lens is the best way to improve the illumination.

Taiwan Utility Model No. M343112 discloses an LEDs unit connected to the reflection member of the illumination device and a base is connected to the rear side of the reflection member. The base has a circuit board. A cup is connected to the front side of the reflection member and has a hole with which a lens is engaged. The lens is located in front of the LEDs unit. The lens may have different shapes and colors so that the illumination device generates different colors of light beams by using different lenses.

The lens is a convex lens which has different curvatures to guide the light beams. Nevertheless, the distance that the light beams reach, the size that the light beams compass and the paths that the light beams follow cannot be changed. For example, a head light for a bicycle is required to illuminate the road in front of the front wheel, however, the current head light can only provide a ring-like light pattern and half of the light beams are wasted and point upward.

The present invention intends to provide a lens for an illumination device to improve the shortcomings mentioned above.

SUMMARY OF THE INVENTION

The present invention relates to a lens for an illumination device and comprises a lens having a first surface and a second surface which is connected to the second surface along an annular curved line which is composed of two symmetric curved lines. The two curved lines are connected to each other at a first end point and a second end point. Each of the two curved lines has a middle point. The first surface is a multiple-focus surface and located on the outer side of the lens. The patterns and paths of the light beams can be controlled by the first surface of the lens.

Preferably, a first curved section is formed between the first point and the middle point. A second curved section is formed between the middle point and the second point.

Preferably, the lens has two curved sections which are symmetrical to each other. Each of the two curved sections is formed between the first/second point to the middle point.

Preferably, the lens has a recess defined in the inner side thereof.

The primary object of the present invention is to provide a lens which is suitable for being cooperated with an illumination device such as a table lamp, street light, flashlight and spot light.

The present invention can be used with single LED or multiple LEDs, by the multiple-focus surface of the lens, the light beams are evenly spread and controlled, no shade is needed. The efficiency of illumination is increased.

The number of the LEDs can be reduced while the desired illumination is obtained.

The less number of the LEDs saves energy required.

The pattern of the light beams can be controlled by the multiple-focus surface of the lens to be oval, circular or semi-circular as needed.

The light beams are evenly spread and controlled to improve the shortcoming that causes fatigue of eyes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
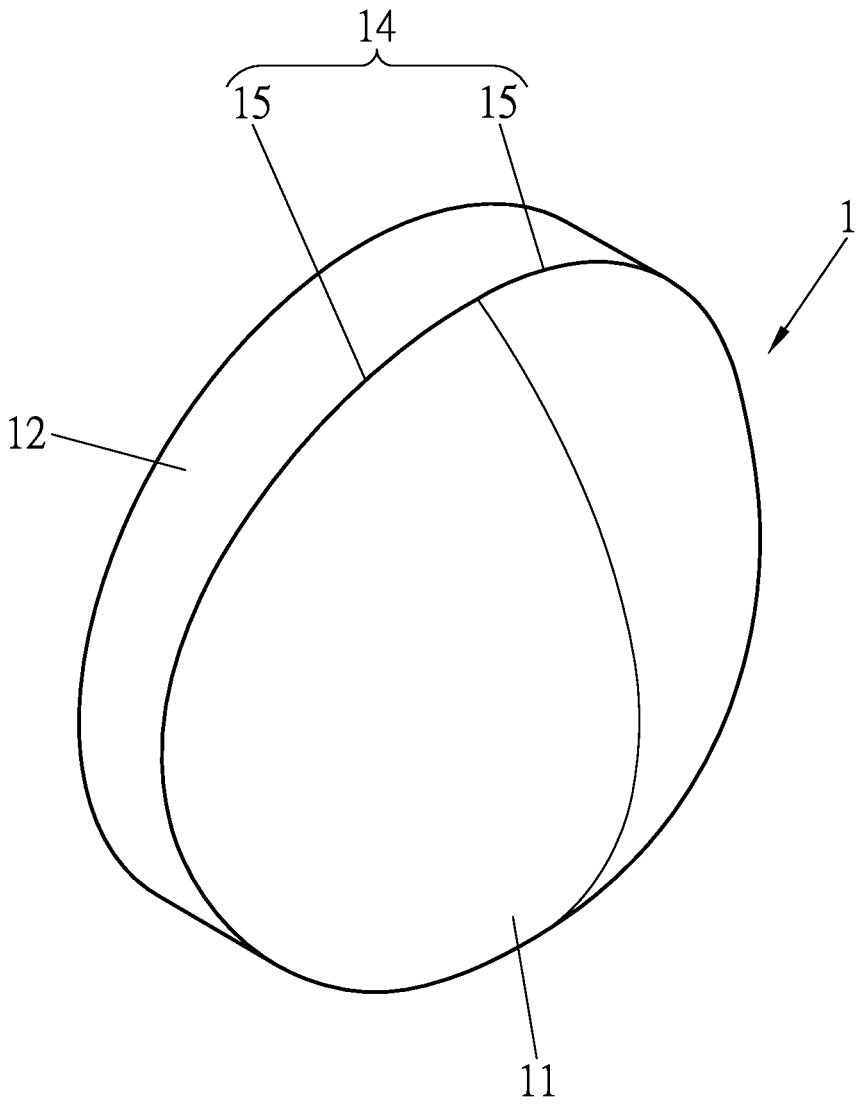
FIG. 1 is a perspective view to show the lens of the present invention.
Figure 2:
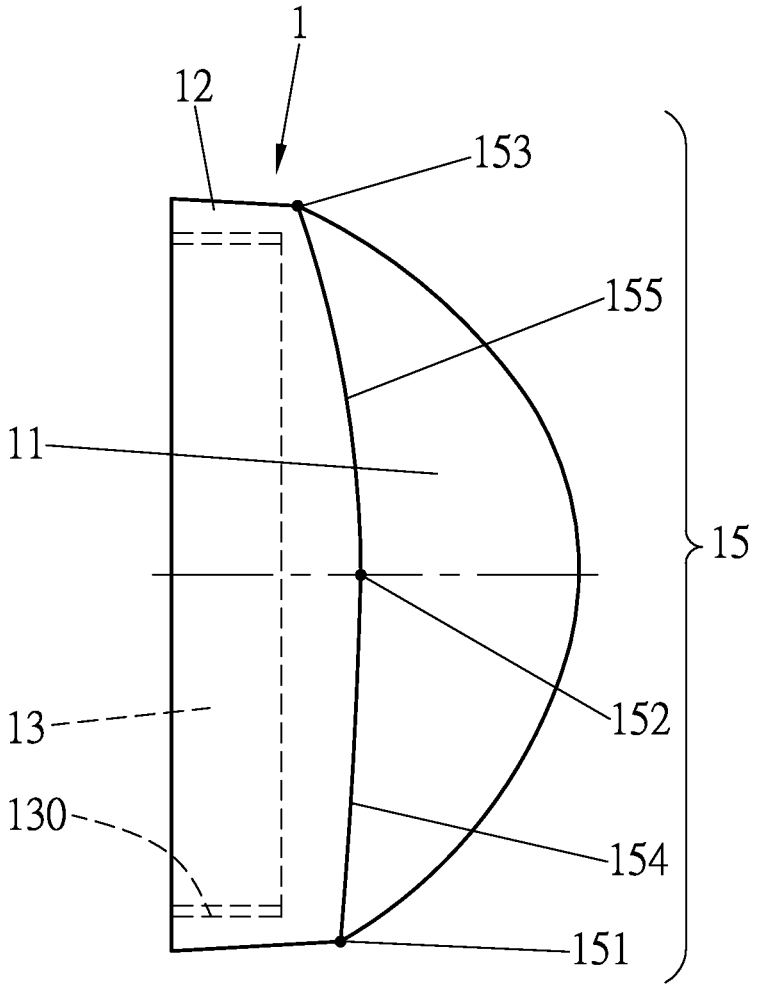
FIG. 2 is a side view to show the lens of the present invention.

Referring to FIGS. 1 and 2, the lens of the present invention comprises a lens 1 having a first surface 11 and a second surface 12. The first and second surfaces 11, 12 are connected to each other along an annular curved line 14 which is composed of two symmetric curved lines 15. The two curved lines 15 are connected to each other at a first end point 151 and a second end point 153, and each of the two curved lines 15 has a middle point 152. The first surface 11 is a multiple-focus surface and located on the outer side of the lens 1. The lens 1 also has a recess 13 defined in the inner side thereof.

Figure 3:
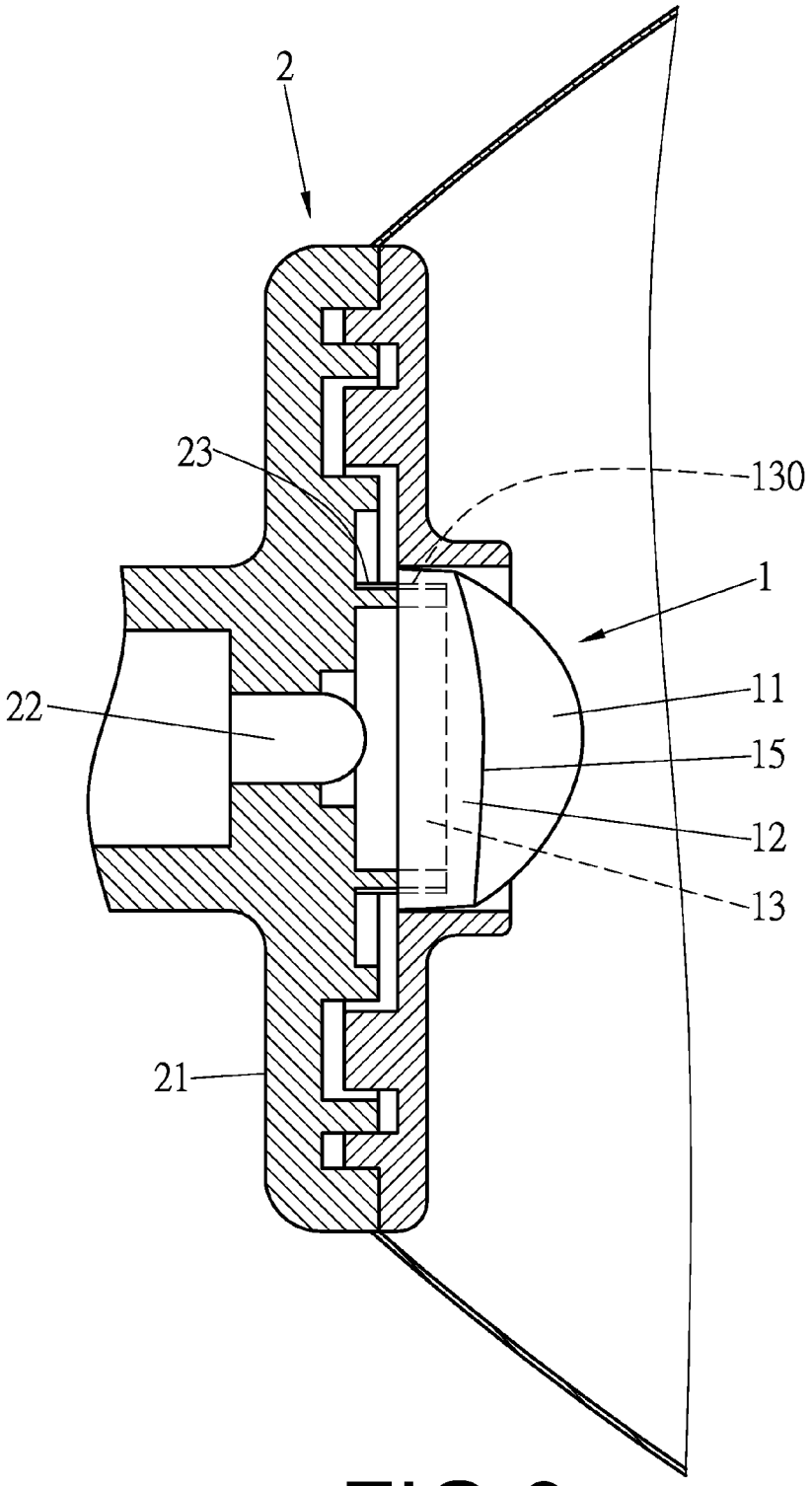
FIG. 3 shows that the lens of the present invention is installed to an illumination device.

As shown in FIG. 3, the lens 1 is suitable for being cooperated with an illumination device 2 such as a table lamp, street light, flashlight and spot light. The illumination device 2 has a base 21 and a light source such as an LED 22 which is located in the base 21. The base 21 has a first connection portion 23 and a second connection portion 130 is formed in the recess 13 of the lens 1. The first and second connection portions 23, 130 are connected to each other to install the lens 1 to the base 21 of the illumination device 2. The first connection portion 23 and the second connection portions 130 are threadedly connected to each other.

Figure 4:
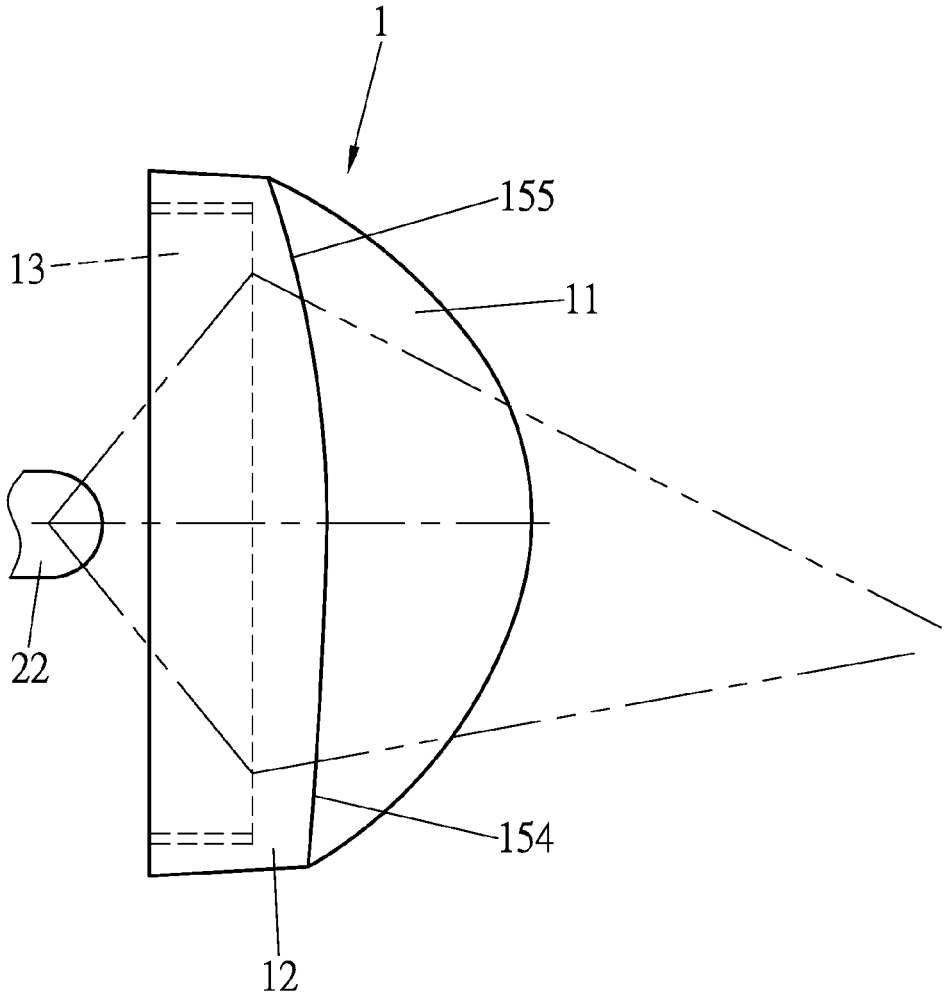
FIG. 4 shows the paths that the light beams from an LED when using the lens of the present invention.

As shown in FIGS. 2 and 4, a first curved section 154 is formed between the first point 151 and the middle point 152, and a second curved section 155 is formed between the middle point 152 and the second point 153. The first curved section 154 is more linear than the second curved section 155 which curves toward the inner side of the lens 1. The lens 1 is suitable for the head light of a bicycle. Some of the light beams from the LED 22 pass through the first curved section 154 and are scattered outward and forward. Some of the light beams from the LED 22 pass through the second curved section 155 and are scattered outward and downward.

Figure 5:
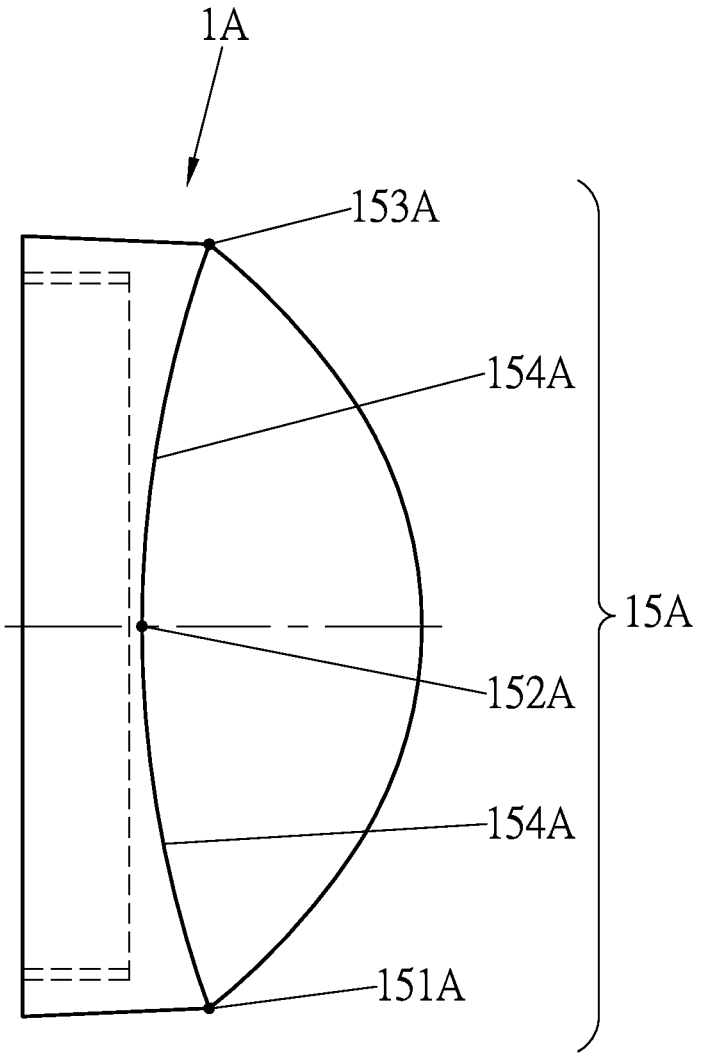
FIG. 5 is a side view to show the second embodiment of the lens of the present invention.
Figure 6:
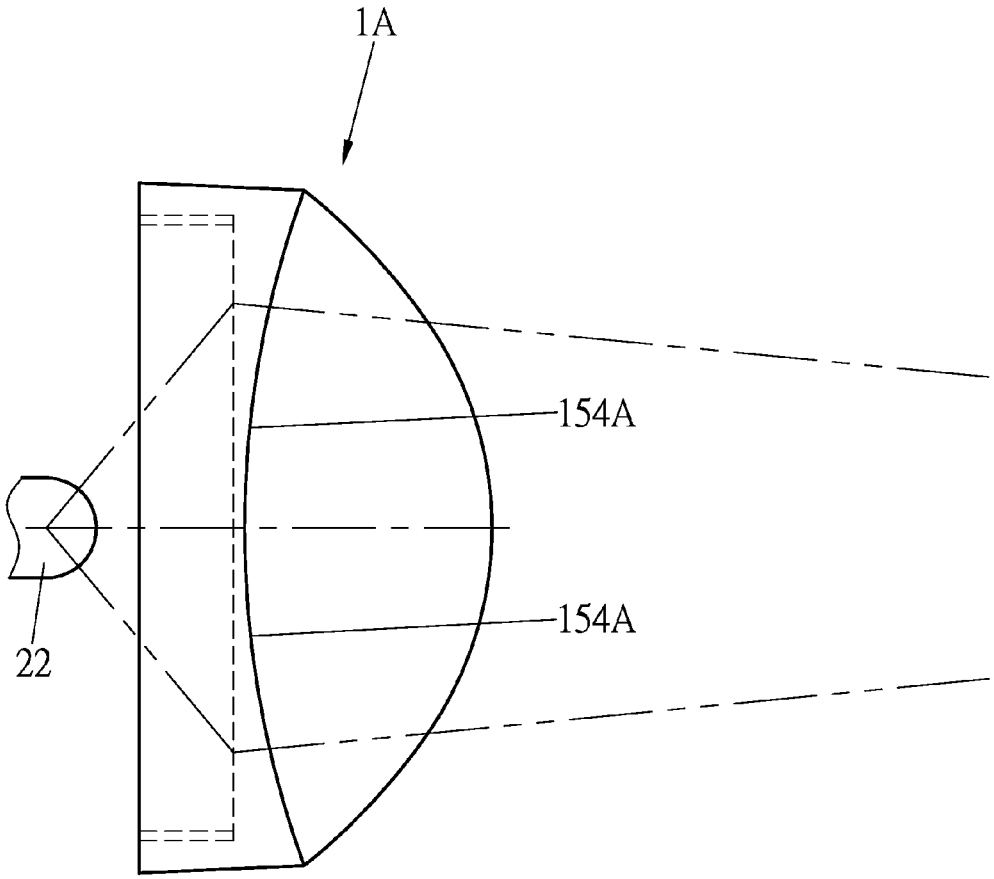
FIG. 6 shows the paths that the light beams from an LED when using the second embodiment of the lens of the present invention.

As shown in FIGS. 5 and 6, the second embodiment of the lens 1 is disclosed, wherein the lens 1A has two curved sections 154A which are symmetrical to each other. Each of the two curved sections 154A is formed between the first/second point 151A/153A to the middle point 152A/152A. As shown in FIG. 6, the lens 1A is suitable for being used as spot light or search light. The light beams from the LED 22 pass through the two curved section 154A and are concentrated forward so that the light beams reach a longer distance and provide more precise illumination.

While we have shown and described the embodiment in accordance with the present invention, it should be clear to those skilled in the art that further embodiments may be made without departing from the scope of the present invention.

What is claimed is:

1. A lens for an illumination device, comprising:

a lens having a first surface and a second surface, the first and second surfaces connected to each other along an annular curved line which is composed of two symmetric curved lines, the two curved lines connected to each other at a first end point and a second end point, each of the two curved lines having a middle point, the first surface being a multiple-focus surface and located on an outer side of the lens.

2. The lens as claimed in claim 1, wherein a first curved section is formed between the first point and the middle point, a second curved section is formed between the middle point and the second point.

3. The lens as claimed in claim 1, wherein the lens has two curved sections which are symmetrical to each other, each of the two curved sections is formed between the first/second point to the middle point.

4. The lens as claimed in claim 1, wherein the lens has a recess defined in an inner side thereof.

* * * * *